US012345103B2

(12) United States Patent
Koskinen et al.

(10) Patent No.: US 12,345,103 B2
(45) Date of Patent: Jul. 1, 2025

(54) DRILL BIT ASSEMBLY COMPRISING AN EXPANDABLE RETAINING SLEEVE

(71) Applicants: SANDVIK MINING AND CONSTRUCTION OY, Tampere (FI); SANDVIK MINING AND CONSTRUCTION TOOLS AB, Sandviken (SE)

(72) Inventors: Jouni Koskinen, Tampere (FI); Olivier Bruandet, Tampere (FI)

(73) Assignees: SANDVIK MINING AND CONSTRUCTION TOOLS AB, Sandviken (SE); SANDVIK MINING AND CONSTRUCTION OY, Tampere (FI)

( * ) Notice: Subject to any disclaimer, the term of this patent is extended or adjusted under 35 U.S.C. 154(b) by 0 days.

(21) Appl. No.: 18/283,389

(22) PCT Filed: Mar. 22, 2022

(86) PCT No.: PCT/EP2022/057475
§ 371 (c)(1),
(2) Date: Sep. 21, 2023

(87) PCT Pub. No.: WO2022/200342
PCT Pub. Date: Sep. 29, 2022

(65) Prior Publication Data

US 2024/0167343 A1 May 23, 2024

(30) Foreign Application Priority Data

Mar. 22, 2021 (EP) ..... 21164079

(51) Int. Cl.
*E21B 17/046* (2006.01)
*E21B 10/36* (2006.01)
*E21B 19/18* (2006.01)

(52) U.S. Cl.
CPC ..... *E21B 17/046* (2013.01); *E21B 10/36* (2013.01); *E21B 19/18* (2013.01)

(58) Field of Classification Search
CPC ..... E21B 17/046; E21B 19/18; E21B 10/36
See application file for complete search history.

(56) References Cited

U.S. PATENT DOCUMENTS 6,131,672 A 10/2000 Beccu et al.
7,117,939 B1 * 10/2006 Hawley ..... E21B 17/076 166/99
2002/0011355 A1 * 1/2002 Wentworth ..... E21B 4/14 175/19

(Continued)

FOREIGN PATENT DOCUMENTS

EP 2896778 A1 7/2015
EP 3214259 A1 9/2017

(Continued)

*Primary Examiner* — Shane Bomar
(74) *Attorney, Agent, or Firm* — Corinne R. Gorski

(57) ABSTRACT

A hammer drill assembly is arranged for coupling to a drill string, wherein the drill bit is releasably attached to a driver sub via a retaining sleeve. The retaining sleeve includes a body that extends between a ring at its forward end and a plurality of tips at its rearward end. Also, methods of attaching and detaching a drill bit from the rest of the assembly are provided.

21 Claims, 12 Drawing Sheets

(56) References Cited

U.S. PATENT DOCUMENTS

| | | | | |
|---|---|---|---|---|
| 2007/0158113 | A1 | 7/2007 | Shofner et al. | |
| 2009/0266613 | A1* | 10/2009 | Bui | E21B 1/00 175/57 |
| 2010/0059284 | A1 | 3/2010 | Lyon et al. | |
| 2010/0139979 | A1 | 6/2010 | Marshall | |
| 2010/0243333 | A1* | 9/2010 | Purcell | E21B 10/36 175/414 |
| 2012/0186883 | A1* | 7/2012 | Purcell | E21B 10/36 175/296 |
| 2015/0330151 | A1* | 11/2015 | Egerström | E21B 17/046 175/305 |
| 2016/0340983 | A1* | 11/2016 | Bruandet | E21B 10/36 |
| 2019/0345772 | A1* | 11/2019 | Bruandet | E21B 34/06 |
| 2020/0190906 | A1* | 6/2020 | Bruandet | E21B 4/14 |
| 2022/0081974 | A1* | 3/2022 | Bruandet | E21B 4/14 |
| 2023/0184037 | A1* | 6/2023 | Maki | E21B 10/36 175/296 |

FOREIGN PATENT DOCUMENTS

| | | | |
|---|---|---|---|
| WO | 98/05476 | A1 | 2/1998 |
| WO | 2012049331 | A2 | 4/2012 |

* cited by examiner

DRILL BIT ASSEMBLY COMPRISING AN EXPANDABLE RETAINING SLEEVE

RELATED APPLICATION DATA

This application is a § 371 National Stage Application of PCT International Application No. PCT/EP2022/057475 filed Mar. 22, 2022 with priority to EP 21164079.2 filed Mar. 22, 2021.

FIELD OF INVENTION

The present invention relates to a percussive drill bit assembly and in particular, although not exclusively, to a down-the-hole assembly wherein the drill bit is axially coupled to a drive component via an expandable sleeve that allows rapid axial detachment of the drill bit from the drive component.

BACKGROUND ART

The technique of down-the-hole (DTH) percussive hammer drilling involves the supply of a pressurised fluid via a drill string to a drill bit located at the bottom of a bore hole. The fluid acts to both drive the hammer drilling action and to flush rearwardly dust and fines resultant from the cutting action, rearwardly through the bore hole so as to optimise forward cutting.

Typically, the drill assembly comprises a casing extending between a top sub and a drill bit that, in turn, is releasably coupled to a driver sub (also known as a chuck). Drilling is achieved via a combination of rotation and axial translation of the drill bit. Rotation is imparted to the drill bit from the driver sub via intermediate engaging splines. The axial percussive action of the bit is achieved via a piston that is capable of shuttling axially between the top sub and the drill bit and is driven by the pressurised fluid to strike a rearward anvil end of the bit. Examples of DTH hammer drills are described in EP3214259A1, U.S. Pat. No. 6,131,672 and US2007158113A1.

Conventionally, the drill bit is retained on the assembly and in contact with the driver sub via a retaining ring accommodated within the assembly. However, these conventional driver coupling arrangements are disadvantageous for a number of reasons. Fundamentally, as a result of the magnitude of the torque transmitted between the driver sub and the hammer casing, it is typically very difficult to remove the driver sub and 'break-open' the assembly without dedicated tooling that may not be available on-site.

Accordingly, there exists a need for a drill bit coupling arrangement that addresses the above problems and provides for the convenient and rapid removal and installation of a replacement drill bit at the driver assembly.

One solution to this problem is disclosed in EP2896778B, which discloses a quick release DTH hammer drill bit assembly in which a drill bit is releasably retained at a drive transmission component (driver sub) via a retaining sleeve and respective retaining formations to axially couple and lock the drill bit at the assembly. The objective of the present invention is to find an alternative quick release assembly that would be easier to automize.

SUMMARY OF THE INVENTION

It is an objective of the present invention to provide a drive coupling for a percussive drill assembly in which a drill bit is releasably retained at a rotational drive component of the assembly via an arrangement that allows both convenient and rapid interchange of replacement drill bits without having to dismantle or decouple additional and unnecessary components forming part of the assembly. It is a further specific objective to provide a coupling arrangement which would be easy to automize.

According to a first aspect of the present invention there is a hammer drill assembly for coupling to a drill string having an axially forward end and an axially rearward end and a longitudinal axis, the assembly comprising: a drill bit positioned at the forward end having a drill head and a bit shaft; an annular driver sub provided axially rearward of the drill bit, the bit shaft accommodated at least partially inside the driver sub; wherein the drill bit is releasably attached to the driver sub via a retaining sleeve; wherein the retaining sleeve is radially positioned at least partially between the driver sub and the drill bit; characterised in that: the retaining sleeve comprises: a plurality of tips that are positioned inside the driver sub; a ring positioned axially forward of the tips; and a body that extends between the ring and the plurality of tips at its rearward end.

Advantageously, this enables quick release of the drill bit from the rest of the assembly as there is no need to unscrew the driver sub in order to change the bit. Instead the elastic deformation of the retaining sleeve enables the drill bit to be easily attached and detached. This design also allows the attachment and detachment of the drill bit from the rest of the assembly to easily be automated. This design could be used on any existing DTH system. The design allows the drill bit to be securely locked in place during drilling and flushing operations, but then easily removed when wanted.

The hammer drill assembly could for example be a DTH drill assembly.

Preferably, each tip has a radially inwardly projecting inner retaining shoulder and a radially outwardly projecting outer retaining shoulder; wherein there is an inner retaining face on the inner retaining shoulder and an outer retaining face on the outer retaining shoulder.

Preferably. the retaining sleeve is made from an elastically deformable material.

Preferably, the bit shaft comprises a radially outwardly projecting retaining shoulder on the radially outer surface of the bit shaft and wherein the driver sub comprises a radially inwardly projecting retaining shoulder on its radially inner surface; and wherein either the bit shaft of the drill bit or the driver sub further comprises an opening groove.

Preferably, the retaining sleeve is made from heat-treated steel. Advantageously, heat-treated steel can provide the needed elasticity for operation in combination with the strength and resilience required in the operating environment.

Preferably, the body of the retaining ring comprises a plurality of fingers, wherein there is a gap between each of the neighbouring fingers, and at least one tip is positioned at the end of each finger. Preferably, there is only one tip on the end of each finger. Advantageously, this offers a good balance between elastic deformability and structural integrity.

Alternatively, the body of the retaining sleeve could be fully cylindrical and made from elastomer, in this case this case tips would be metal inserts and there would only be gaps between the neighbouring tips and not between any sections of the body. Or the whole retaining sleeve could be over-moulded with an elastic material.

Preferably, the retaining sleeve comprises between 3-30 fingers. Advantageously, this offers a good balance between elastic deformability and structural integrity.

Preferably, the width of the gaps between each two neighbouring fingers on the retaining ring increases along the axial length of the fingers from the ring towards the tip and then decreases in width between each two neighbouring tips. Advantageously, this design results in lower stresses in the retaining sleeve as it is deformed, therefore reducing the risk of breakage and increasing the lifetime of the part and it also lowers the force needed for installation and removal of the sleeve.

Preferably, a radially outer surface on the ring of the retaining sleeve comprises a U-shaped groove. Advantageously, when the drill bit is being attached or removed from the rest of the assembly, the presence of the U-shaped groove enables the grabbing tool to be able to get a more secure grip on the retaining sleeve.

Preferably, an axially forward surface and/or an axially rearward surface of the ring on the retaining sleeve comprises a damping element. Advantageously, this adds durability to the retaining sleeve as it provides a cushion for the drilling impacts and reduces the induced vibrations.

Preferably, an axial endmost surface on each of the tips on the retaining sleeve is chamfered. Advantageously, this eases the insertion of the retaining sleeve into the drilling assembly.

Preferably, when the assembly is in its flushing position, between the inner retaining face on the retaining sleeve and the radially outwardly projecting retaining shoulder on the drill bit a first contact force is achieved and between the outer retaining face on the retaining sleeve and the radially inwardly projecting retaining shoulder on the driver sub a second contact force is achieved. Advantageously, this enables the drill bit to be retained in the rest of the assembly whilst the assembly is moved from the drilling to flushing the position.

Preferably, there is a co-linear vector between the first and second contact forces. Advantageously, this prevents the fingers on the retaining sleeve from being able to bend when the drill bit is in its flushing position.

Preferably. the driver sub further comprises a chamfer on its axial forward side for entry of the retaining sleeve. Advantageously, this aids with the installation of the retaining sleeve into the driver sub.

According to another aspect of the present application there is a drill bit for a drill assembly having a forward end; a rearward end and a longitudinal axis comprising: a drill head at its forward end; a bit shaft; and a plurality of splines on the outer surface of the bit shaft at the rearward end; wherein there is a radially inwardly projecting opening groove on the bit shaft positioned axially between the splines and the drill head and a radially outwardly projecting retaining shoulder that projects radially outwards compared to the opening groove positioned on the rearward side of the opening groove.

According to another aspect of the present application there is a driver sub for use in a drilling assembly having a forward end; a rearward end and a longitudinal axis: wherein there is a radially outwardly projecting opening groove on its inner surface and a radially inwardly projecting retaining shoulder positioned on the forward side of the opening groove.

Preferably the drill bit or the driver sub further comprises a tapered support face extending between the retaining shoulder and the opening groove. Advantageously this helps to reduce the gap between retaining fingers and bit or driver sub while moving to retaining/flushing position and will help to secure the bit retention.

Preferably, the bit shaft and the driver sub have a plurality of interlocking splines.

According to another aspect of the present invention there is a method of attaching a drill bit to the rest of the drill assembly according to any of claims 1-15 when the opening groove is positioned on the drill bit, comprising the steps of:

a. installing the retaining sleeve around the drill bit;
b. positioning a spacer between the retaining sleeve and the drill bit so that an innermost surface of the tips on the retaining sleeve is positioned above the opening groove;
c. gripping the retaining sleeve with a grabbing tool;
d. rotating the drill bit or assembly until engagement between the splines on the drill bit and the splines on the driver sub is achieved;
e. applying axial force to the drill bit or assembly so that the body on the retaining sleeve contracts as the drill bit slides inside the driver sub;
f. pushing the drill bit so that the tips of the retaining sleeve are pushed past the stepped region on the driver sub and the body of the retaining sleeve reverts back to its original, non-contracted, position;
g. releasing the drill bit from the grabbing tool.

According to another aspect of the present application there is a method of attaching a drill bit to the rest of the drill assembly according to any of claims 1-15 when the opening groove is positioned on the driver sub, comprising the steps of:

a. installing the retaining sleeve inside the driver sub;
b. positioning a spacer between the retaining sleeve and the driver sub so that the radially outermost surfaces of the tips on the retaining sleeve are positioned above the opening groove on the driver sub;
c. gripping the retaining sleeve using a grabbing tool;
d. rotating the drill bit or assembly until engagement between the splines on the drill bit and the splines on the driver sub is achieved;
e. applying axial force to the drill bit or assembly so that the body of the retaining sleeve expands as the drill bit slides inside the driver sub;
f. pushing the drill bit so that the tips on the retaining sleeve are pushed past the retaining shoulder of the drill bit and the body reverts back to its original, non-expanded, position;
g. releasing the drill bit from the grabbing tool.

Another aspect of the present application is a method of detaching the drill bit from the rest of the assembly according to any of claims 1-15 when the opening groove is positioned on the drill bit comprising the steps of:

a. extending the drill bit to its flushing position;
b. gripping the retaining sleeve with a grabbing tool;
c. positioning a spacer between the retaining sleeve and the drill bit;
d. pushing the drill bit partially back inside the assembly so that an innermost surface of the tips on the retaining sleeve are positioned above the opening groove on the drill bit;
e. axially pulling the retaining sleeve or the assembly from the assembly so that the body of the retaining sleeve contracts;
f. continuing pulling the retaining sleeve until the body of the retaining sleeve reverts back to its original position;
g. pulling the drill bit axially further forward so that the splines on the drill bit and the driver sub disengage and the drill bit and retaining sleeve can be removed from the rest of the assembly.

In this method the retaining sleeve will remain on the drill bit but can then easily be removed from the drill bit.

Another aspect of the present application is a method of detaching the drill bit from the rest of the assembly according to any of claims 1-15 when the opening groove is positioned on the driver sub comprising the steps of:

a. extending the drill bit to its flushing position;
b. gripping the retaining sleeve with a grabbing tool;
c. positioning a spacer between the retaining sleeve and the driver sub;
d. pushing the retaining sleeve partially back inside the assembly so that a radially outermost surfaces of the tips on the retaining sleeve are positioned above the opening groove on the driver sub;
e. axially pulling the drill bit from the assembly so that the body of the retaining sleeve expands;
f. continuing pulling the drill bit until the body of the retaining ring reverts at least partially back to towards its original position; It may be so that the body of the retaining sleeve will only revert fully back when the splines are already disengaged.
g. pulling the drill bit axially further forward so that the splines on the drill bit and the driver sub disengage and the drill bit can be removed from the rest of the assembly. At this point the retaining sleeve remain inside driver sub, but then the two parts can easily be separated.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
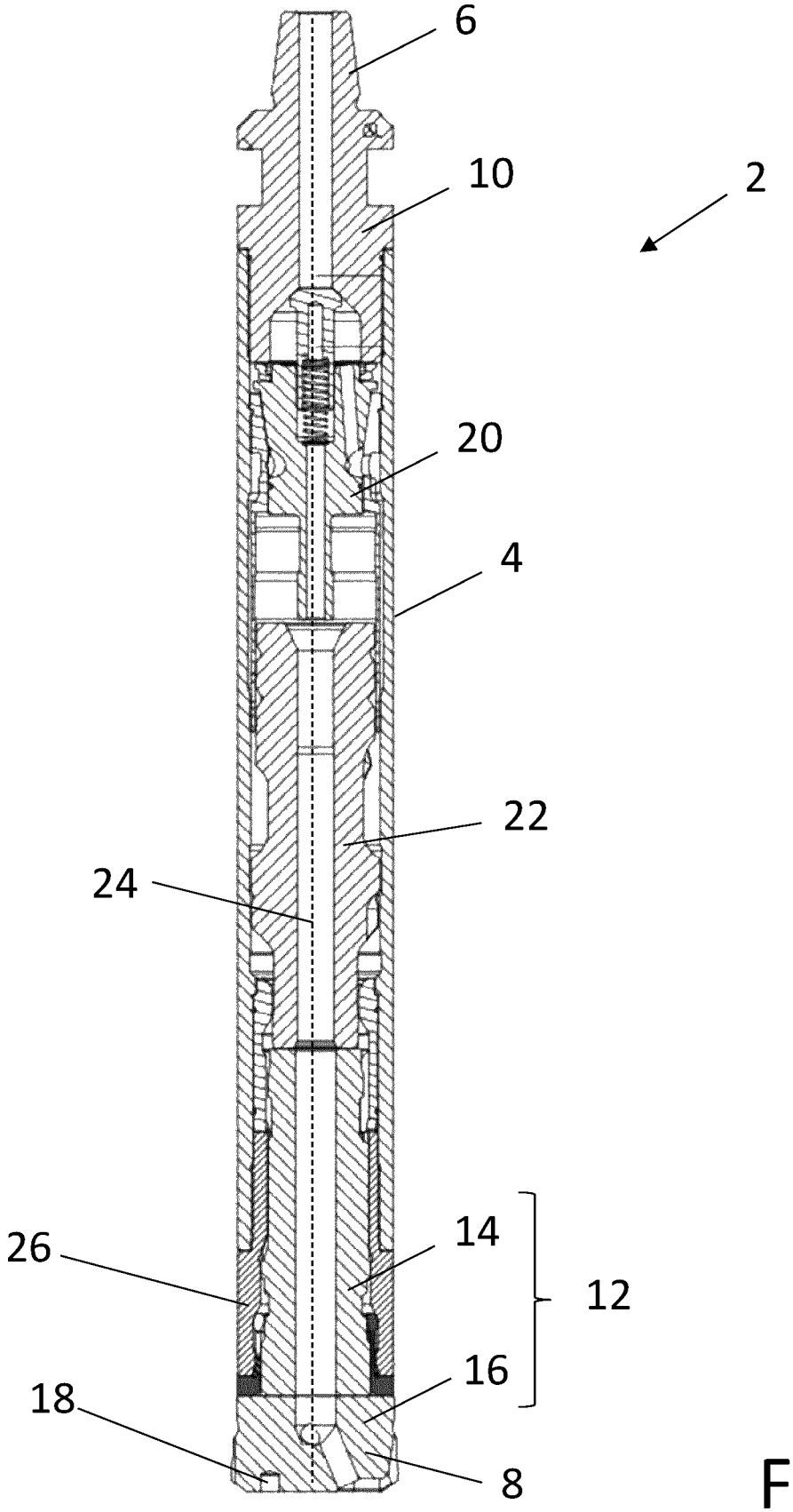
FIG. 1 is a cross section of a DTH assembly.

FIG. 1 shows a cross section of a down the hole (DTH) hammer assembly 2 comprising a substantially hollow cylindrical casing 4 having an axially rearward end 6 (attachment end) and an axially forward end 8 (cutting end). A top sub 10 is at least partially accommodated within the rearward of casing 4 whilst a drill bit 12 (cutting head) is at least partially accommodated within the forward end of the casing 4. The drill bit 12 comprises a bit shaft 14 (shank) and a drill head 16 having a plurality of wear resistant cutting buttons 18.

A distributor cylinder 20 extends axially within casing 4 and an elongate substantially cylindrical piston 22 extends axially within cylinder 20 and casing 4 and, the piston 22 is capable of shuttling back and forth along a central longitudinal axis 24 extending through the assembly 2. Pressurised fluid is delivered to assembly 2 via a drill string (not shown) that is coupled to the top sub 10. Fluid passages are arranged inside the hammer assembly 2 to drive the piston's 22 motion. Fluid is alternatively pressurized and vented into and out of the drive chambers. Exhaust of the pressurized fluid from the assembly 2 is used to remove cutting from the drilled hole.

A driver sub 26 (alternatively termed a drive chuck) is positioned towards the forward end the assembly 2 surrounding the bit shaft 14. The axially forward end of the driver sub 26 is positioned towards bit head 16 and an axially rearward end of the driver sub 26 is accommodated within an axially forward region of casing 4.

Figure 2:
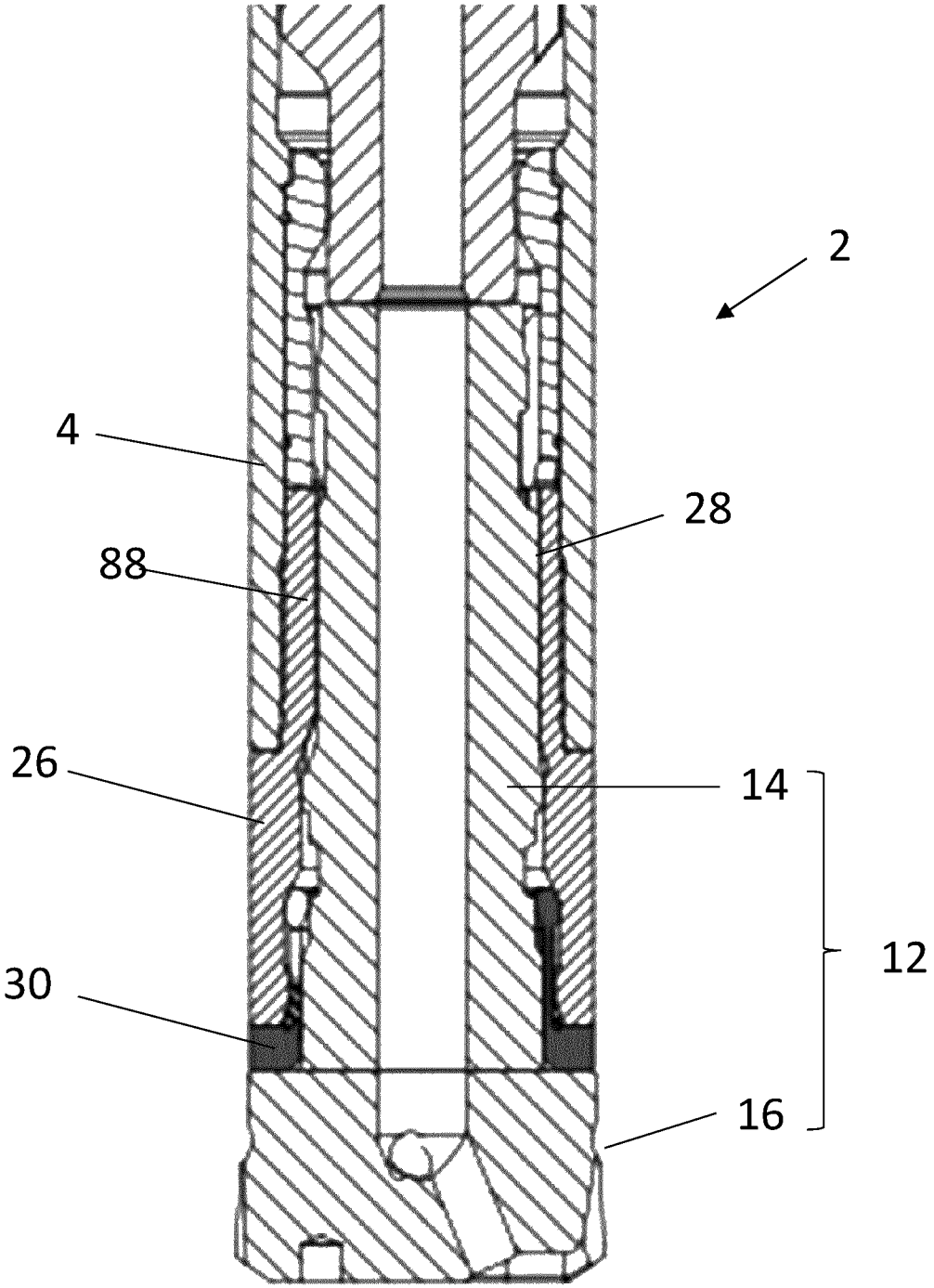
FIG. 2 is an enlargement of FIG. 1 in the region of the retaining sleeve.

FIG. 2 shows a more detailed view of the cross section of the forward end of the assembly 2 in the region where the driver sub 26 is mated in contact with the bit shaft 14 via a plurality of splines 28 that extend both axially and radially on the radially outward facing surface of bit shaft 14 (also see FIG. 6) that inter engage with a plurality of splines 88 that extend both axially and radially on the radially inward facing surface of the driver sub 26 (also see FIG. 7). Rotational drive to the bit head 16 is transmitted from the drill string (not shown) through casing 4 and driver sub 26 to drill bit 12. The drill bit 12 is retained axially in the assembly 2 via a retaining sleeve 30 that is positioned radially between the bit shaft 14 and the forward end of the driver sub 26. The axially forward end of the retaining sleeve 30 is positioned in contact with the drill head 16. The retaining sleeve 30 is positioned at least partially between the driver sub 26 and the drill bit 12. The retaining sleeve 30 is forwardly removable from the driver sub 26.

Figure 3A:
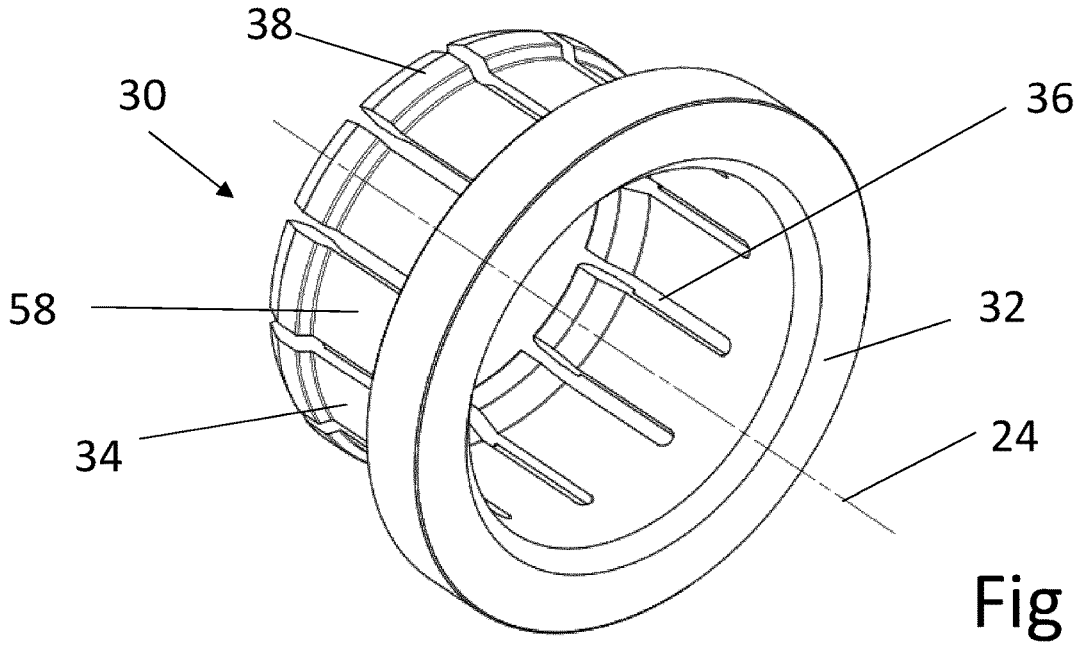
FIGS. 3*a*, 3*b* and 3*c* are a perspective views of alternative embodiments of the inventive retaining sleeve.
Figure 3B:
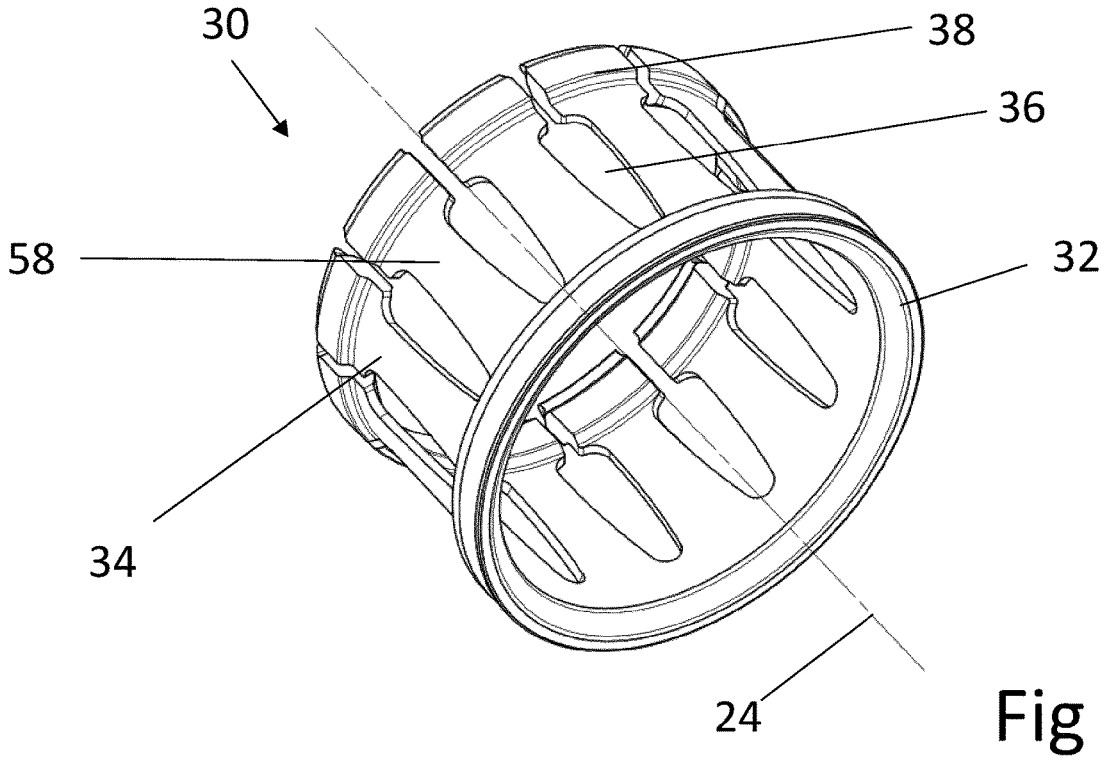
Figure 3C:
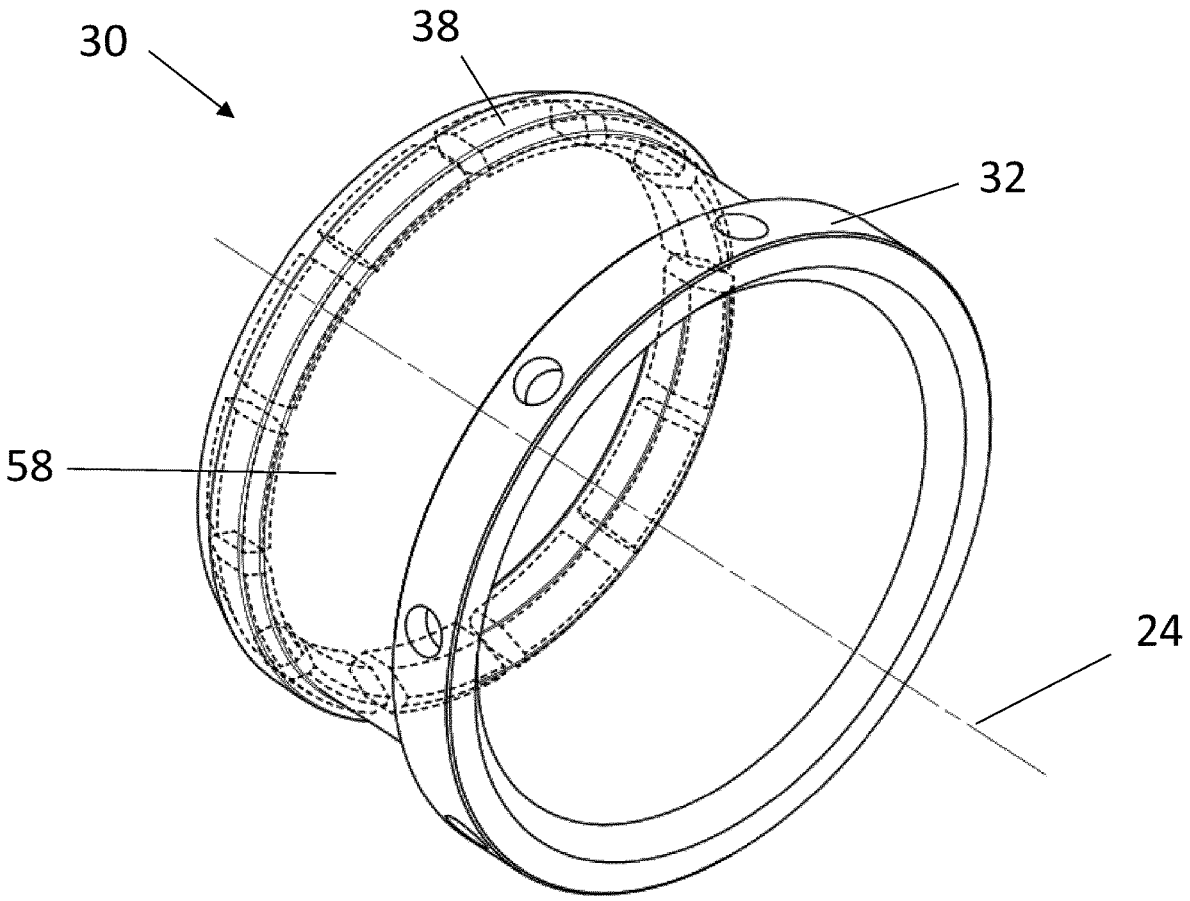

FIGS. 3*a*, 3*b* and 3*c* show a perspective views of alternative embodiments of the retaining sleeve 30 in more detail. The retaining ring 30 is arranged to be at least partly expandable and can be made of material such as heat-treated steel, polymer or composite structure. At the forward end of the retaining sleeve 30, which will be in contact with the drill head 16, there is a ring 32, preferably a continuous ring 32, the retaining sleeve further comprises a body 58 that extends between the ring 32 to a plurality of tips 38 at its rearward end. FIGS. 3*a* and 3*b* show that in one embodiment the body 58 is in the form of a plurality of fingers 34 that extend axially rearward from the ring 32, with a gap 36 in between pair of neighbouring fingers 34. The number of fingers is preferably between 3-30, more preferably between 8-16. In this case the tips 38 are at the rearward ends of each finger 34. The size of the gap 36 is large enough such that the tips 38 on two adjacent fingers will not touch each other as the shape of the retaining ring 30 changes as it is manoeuvred into and out of its retaining position within the assembly 2. FIG. 3*a* shows that the size of the gap 36 between each of the fingers 34 could be essentially the same along its entire axial length of the finger 34, including its body 58 and tip 38. FIG. 3*b* shows that alternatively the width of the gap may vary along its axial length, for example, the width of the gap may increase along the axial length of the body 58 of the finger 34 from the ring 32 towards the tip 38 and then decrease in width between each of the tips 34. FIG. 3*c* shows that alternatively, the body 58 of the retaining sleeve 30 could be fully cylindrical and made from elastomer, in this case tips 38 would be metal inserts and there would only be gaps 36 between the neighbouring tips 38 and not between any sections of the body 58. Or the whole retaining sleeve 30 could be over-moulded with an elastic material.

Figure 4:
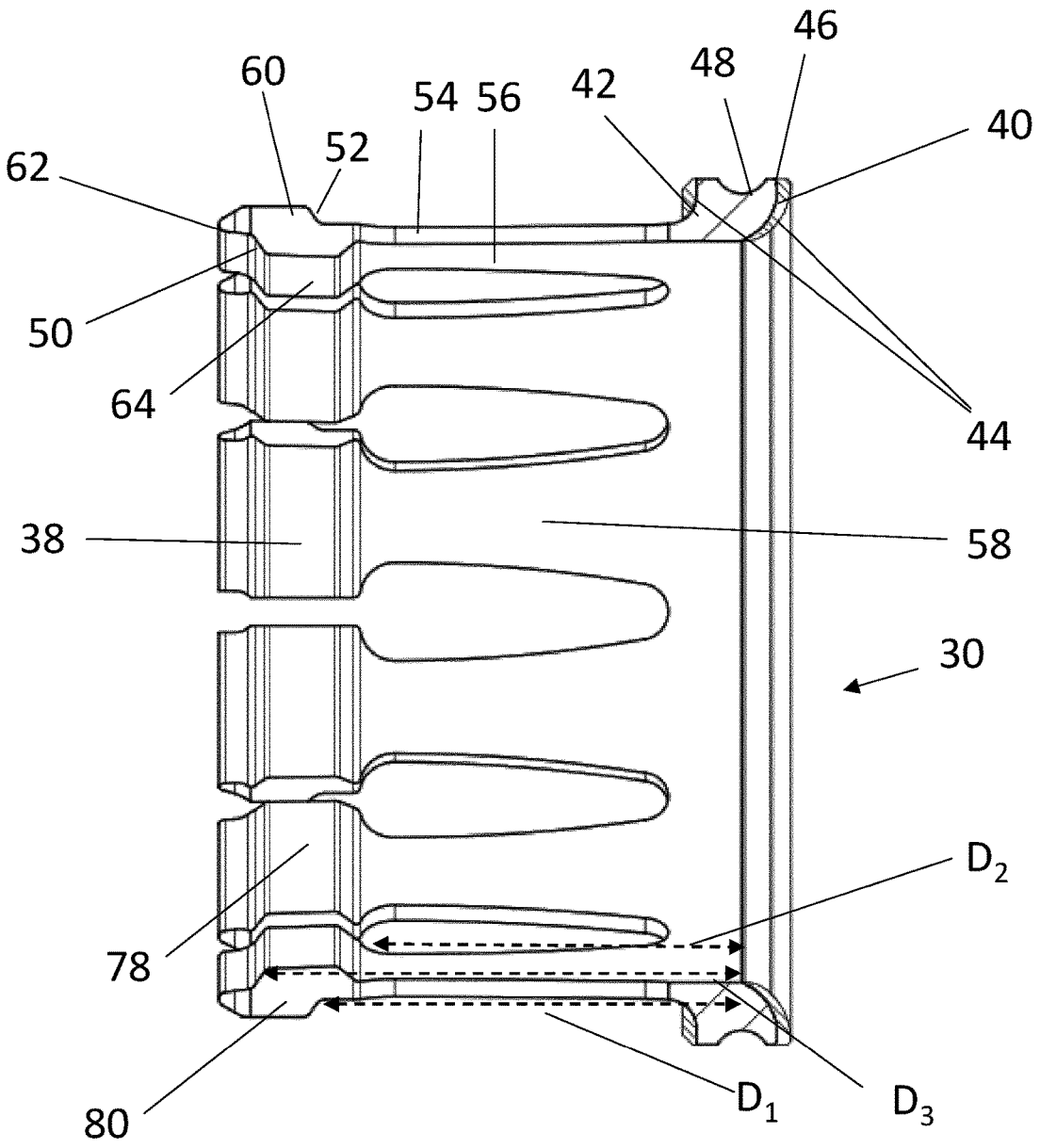
FIG. 4 is a projected cross section of the FIG. 3*b*.

FIG. 4 shows a side view of a section of the retaining sleeve 30. Each of the tips 38 on the retaining sleeve 30 has a radially inwardly projecting inner retaining shoulder 78 and a radially outwardly projecting outer retaining shoulder 80. Preferably, the inner retaining shoulder 78 is positioned axially nearer to the ring 32 than the outer retaining shoulder 80.

Each body 58 of the finger 34 has a radially outer surface 54 and a radially inner surface 56. In the region of the tip 38 the radially outer surface 54 projects radially further outwards compared to the body 58 of the finger 34 at a first distance, $D_1$, from the ring 32 at an angle of between 95°-170° with respect to the longitudinal axis 24 to a radially outermost surface 60 that is preferably parallel with the longitudinal axis 24. An outer retaining face 52 that is non-parallel with the longitudinal axis 24 is formed between the radially outermost surface 60 and the radial outer face 54. When positioned in the assembly 2 and the assembly is in its flushing/retaining position, the outer retaining face 52 is in contact with the driver sub 26. The radially inner surface 56 projects radially further inwards at a second distance, $D_2$, from the ring 32 at an angle of between 10°-85° with respect to the longitudinal axis 24 to a radially innermost surface 64 that is preferably parallel with the longitudinal axis 24. At a third distance, $D_3$, from the ring 32, the radially innermost surface 64 projects radially outwards at an angle of between 95°-170° with respect to the longitudinal axis 24, to an axially endmost surface 62. An inner retaining face 50, that is non-parallel with the longitudinal axis 24, is formed between the radial innermost surface 64 and the inner surface of the axial end 62. When positioned in the assembly 2 and the assembly 2 is in the flushing/retaining position, the inner retaining face 50 is in contact with the drill bit 12. The distance $D_1<D_3$. The outer retaining face 52 is positioned nearer to ring 32 than inner retaining face 50.

The diameter of the retaining sleeve 30 to the radially outermost surface 60 at the tips 38 is greater compared to the diameter to the radial outer surface 54 of the body 58 of the fingers 34. The diameter of the retaining sleeve 30 at the radially innermost surface 64 at the tips 38 is smaller compared to the diameter of the radial inner surface 56 of the body 58 of the fingers 34.

The rearward axial endmost surface 62 of the tips 38 may either be perpendicular to the longitudinal axis 24 or may be chamfered such that it projects at an angle between 10°-60° with respect to the longitudinal axis.

An axially forward surface 40 and/or an axially rearward surface 42 of the ring 32 on the retaining sleeve 30 may optionally comprise a damping element 44. The damping element 44 could be made from polyurethane, rubber or other dampening material. The damping element 44 could be bonded, cast or over-moulded on the retaining sleeve 30.

A radially outer surface 46 of the ring 32 on the retaining sleeve 30 preferably contains a U-shaped grove 48 for assisting a grabbing tool 74 (shown in FIGS. 9 and 11) to obtain a good grip, but could alternatively be flat or any other shape which will aid the grabbing tool 74 achieving a strong grip. There could be other grabbing features that assist the grabbing tool achieving a strong grip, such as side holes. If there is no U-shaped groove, the grabbing tool would interact with the axially rearward surface 42.

Figure 5:
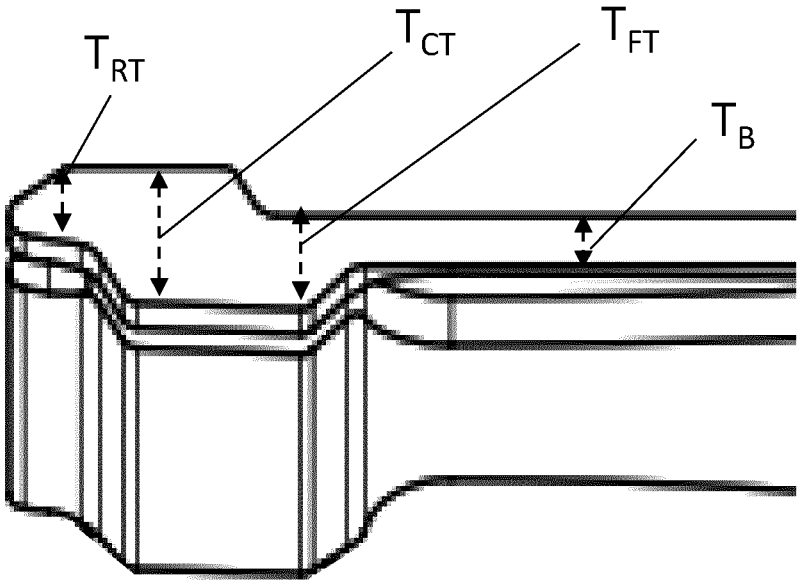
FIG. 5 is an enlargement of FIG. 4 of one of the fingers on the retaining sleeve.

FIG. 5 shows a side view of one of the fingers 34. The main body of the fingers 34 has a thickness, $T_B$. The central portion of the tip 38 has a thickness, $T_{CT}$. The forward end of the tip 38 has a thickness, $T_{FT}$. The rearward end of the tip 38 has a thickness, $T_{RT}$. The relationship of the thicknesses is such that $T_{CT}>T_{FT}>T_B$ and $T_{CT}>T_{RT}$.

Figure 6A:
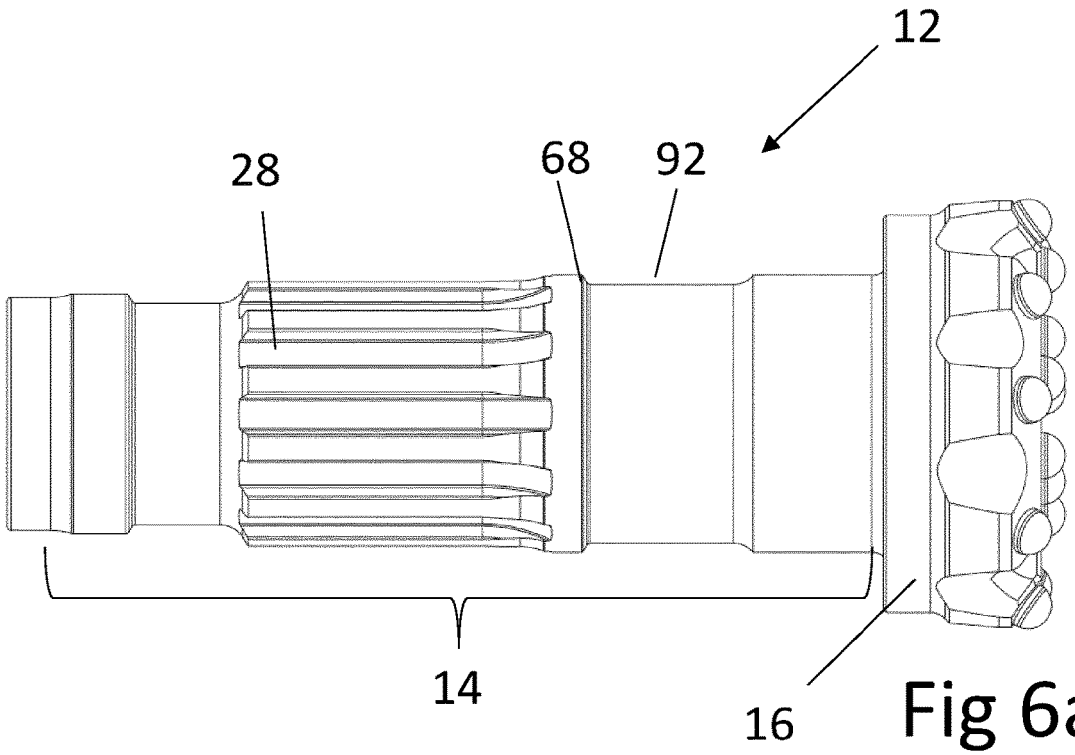
FIGS. 6*a* and *b* are projective views of alternative embodiments of the drill bit.
Figure 6B:
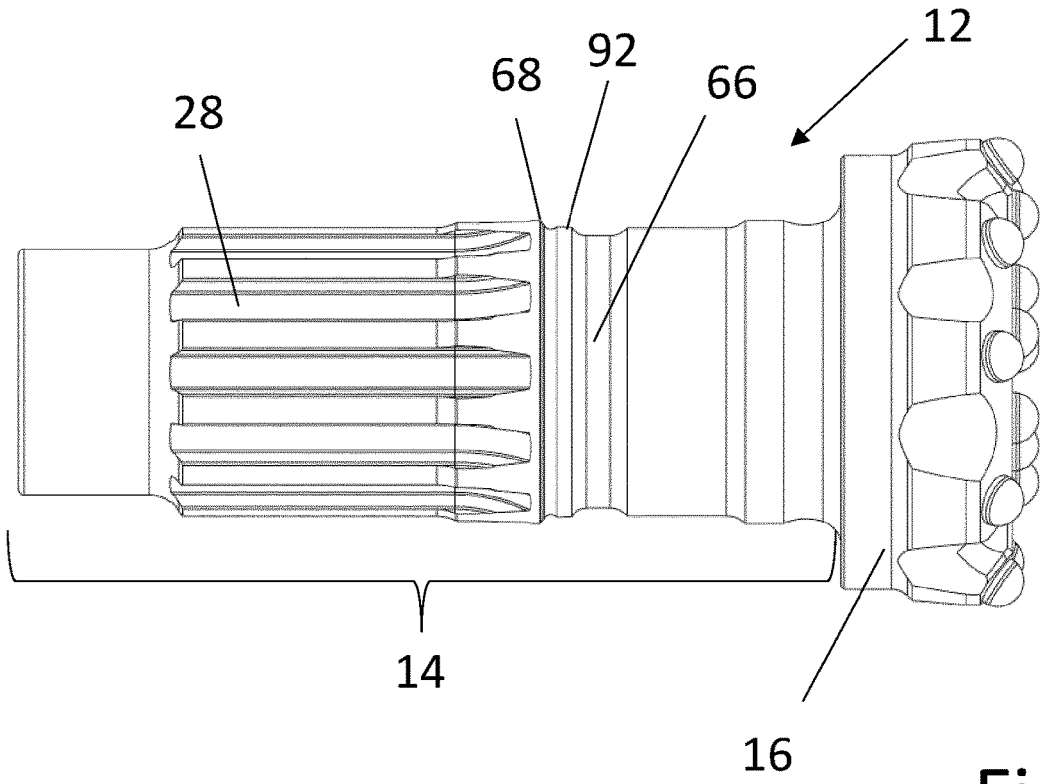

FIGS. 6*a* and 6*b* show projective views of alternative drill bit 12 designs. In order for the retaining sleeve 30 to be able to hold the drill bit 12 in the assembly 2, there is a radially outwardly projecting retaining shoulder 68 located on the radially outer surface of the bit shaft 14 of the drill bit. Preferably, the shoulder 68 is positioned axially between the splines 28 and the drill head 16.

Figure 7A:
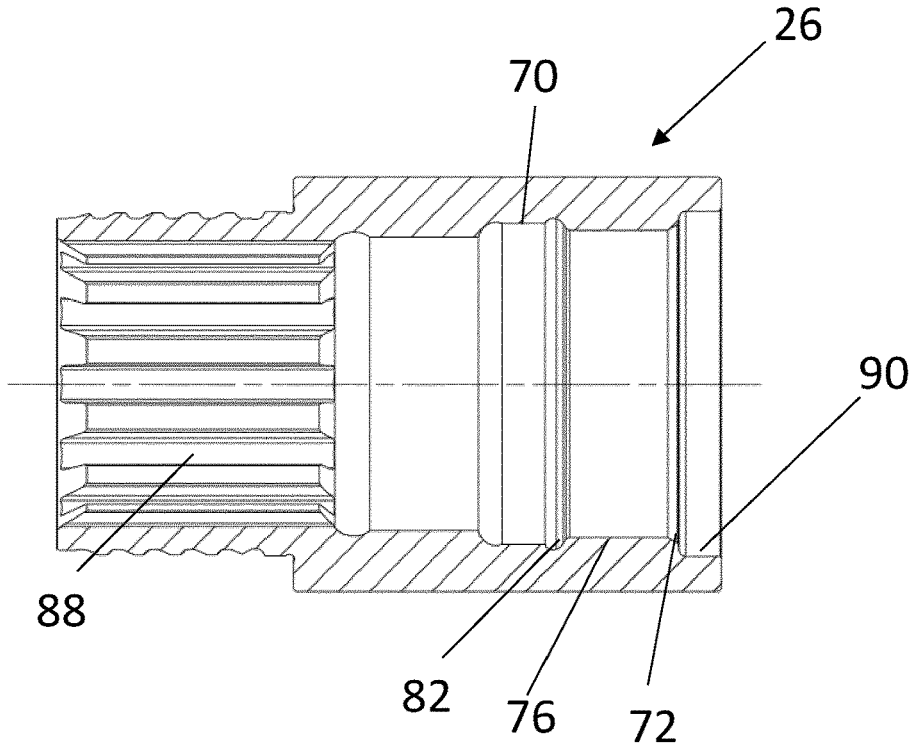
FIGS. 7*a* and 7*b* are a cross sections of alternative embodiments of the driver sub.
Figure 7B:
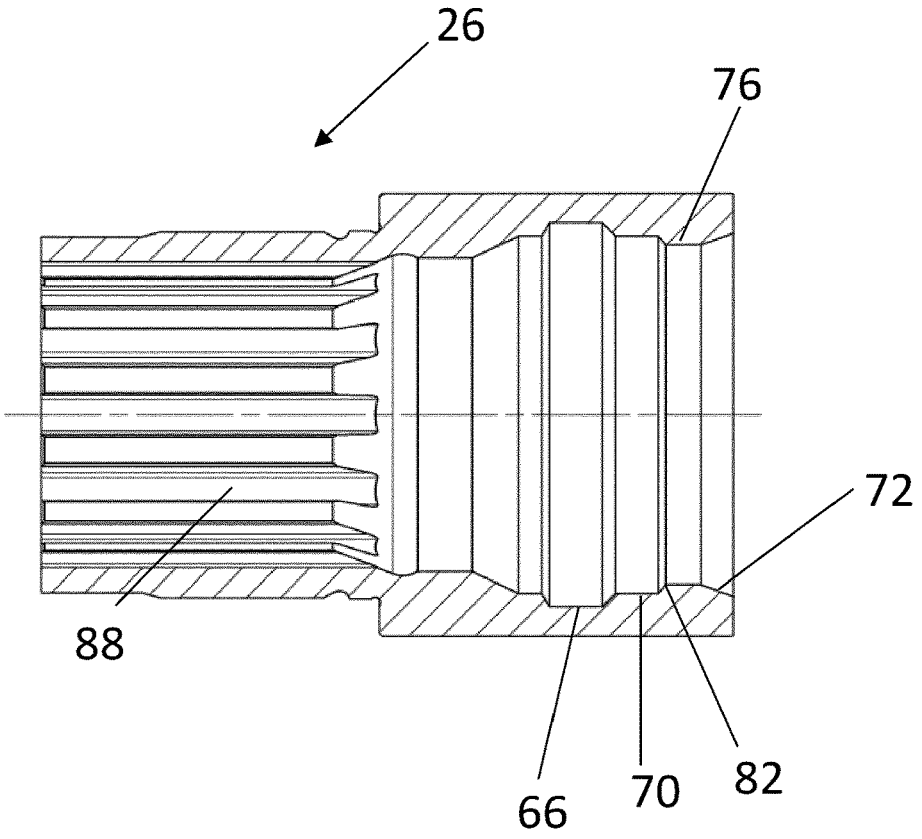

FIGS. 7*a* and 7*b* show cross section views of alternative driver sub 26 designs. The drive sub 26 comprises an inwardly projecting stepped region 76, having a smaller diameter compared to a support surface 70 of the driver sub 26. In order for the retaining sleeve 30 to be able to hold the drill bit 12 in the assembly 2, there is a radially inwardly projecting retaining shoulder 82 located on the radially inner surface of the driver sub 26. Optionally, there is a recess 90 on the forward end of the driver sub 26 to accommodate the retaining sleeve 30, so that the retaining sleeve 30 can be fully concealed inside the driver sub 26.

To allow the drill bit 12 to be removed from the assembly 2 when required, either the drill bit 12 or the driver sub 26 needs to also have an opening groove 66 to allow the retaining sleeve 30 to elastically deform. If the groove 66 is positioned on the drill bit 12, the retaining sleeve 30 elastically deforms to pass over the radially inwardly projecting shoulder 82 on the driver sub 26 (this is shown in FIG. 6*b* for the drill bit 12 and FIG. 7*a* for the driver sub 26). If the groove 66 is positioned on the driver sub 26, then the sleeve elastically deforms to pass over the radially outwardly projecting shoulder 68 on the drill bit 12. This is shown in FIG. 6*a* for the drill bit 12 and FIG. 7*b* for the driver sub 26.

Therefore, either the drill bit 12 shown in FIG. 6*a* is used in combination with the driver sub 26 design shown in FIG. 7*b* so that the opening groove 66 is positioned on the driver sub 26 or the drill bit 12 design shown in FIG. 6*b* is used in combination with the driver sub 26 design shown in FIG. 7*a* so that the opening groove 66 is positioned on the bit shank 14 of the drill bit 12.

If the opening groove is on the drill bit 12 as shown in FIG. 6*b*, the bit shank 14 has a region wherein its outer surface projects radially inwardly, therefore creating the opening groove 66, this area of the bit shank 14 therefore has a reduced diameter in the appropriate position to be able to accommodate the tips 38 of the retaining sleeve 30 when installed in the assembly 2. The radially outwardly projecting retaining shoulder 68 is positioned on the rearward side of the opening groove 66. The retaining shoulder 68 projects radially outwards compared to the opening groove 66. There is a support face 92 on the bit shaft 14 that extends between the retaining shoulder 68 and the opening groove 66, optionally the support face 92 is tapered, providing a gradual increase in the diameter of the outer surface of the bit shaft 14 from the opening groove 66 to the retaining shoulder 68.

If the opening groove 66 is on the driver sub 26 as shown in FIG. 7*b*, the driver sub 26 has a region wherein its inner surface projects radially outward, therefore creating the opening groove 66. This area of the driver sub 26 therefore has an increased inner diameter in the appropriate position to be able to accommodate the tips 38 of the retaining sleeve 30 when in position in the assembly 2. The radially inwardly projecting retaining shoulder 82 is positioned on the forward side of the opening groove 66. The retaining shoulder 82 projects radially inwards compared to the opening groove 66. Optionally, the support face 70 on the driver sub 26 that extends between the retaining shoulder 82 and the opening groove 66 is tapered, therefore providing a gradual decrease in the diameter of the inner surface of the driver sub 26 from the opening groove 66 to the retaining shoulder 68. Preferably, there is a chamfer 72 on the axial forward side of the driver sub 26, to aid the entry of the retaining sleeve 30 during installation.

Figure 8:
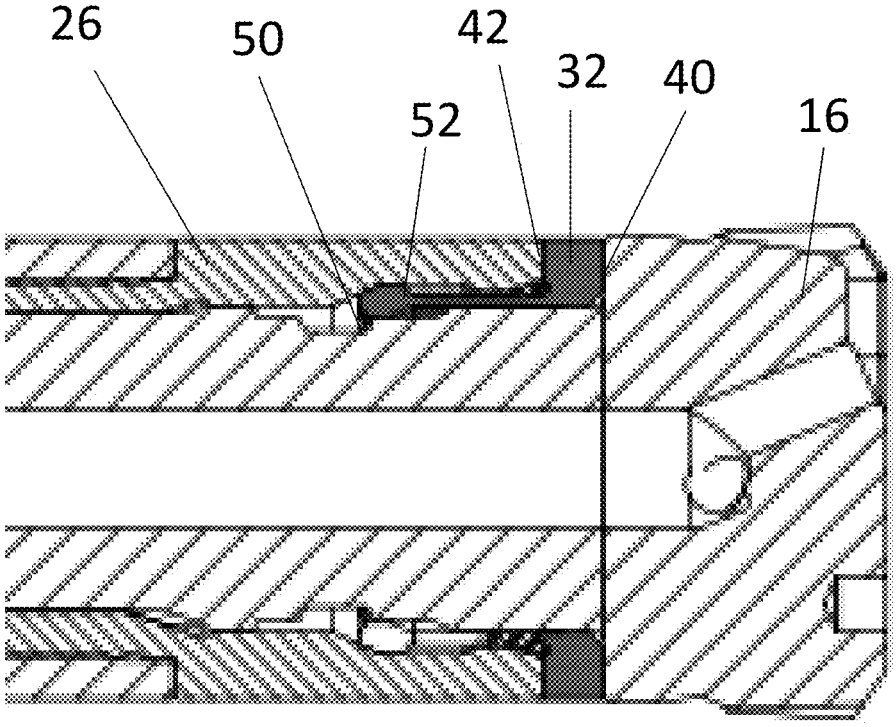
FIG. 8 is a cross section of the DTH assembly with the retaining sleeve in its drilling position.

FIG. 8 shows the retaining sleeve 30 installed in the drilling assembly 2. The axially forward surface 40 of the ring 32 on the retaining sleeve 30 is positioned adjacent the rearward side of the drill head 16. The axially rearward surface 42 of the ring 32 on the retaining sleeve 30 is positioned adjacent to the axial forward end on the driver sub 26. The radially outer surface 54 of the retaining sleeve 30 is positioned adjacent to the radially inner surface of the driver sub 26. Optionally, there is a recess 90 on the forward end of the driver sub 26, as shown in FIG. 7*a* so that the retaining sleeve 30 can be positioned fully inside the driver sub 26 during the drilling operation so that it is not externally exposed. However, it is also possible for the forward end of the retaining sleeve 30 to be positioned between the forward end of the driver sub 26 and the drill head 16 so that is not fully inside the driver sub 26 and therefore externally exposed as shown in FIG. 8.

Figure 9A:
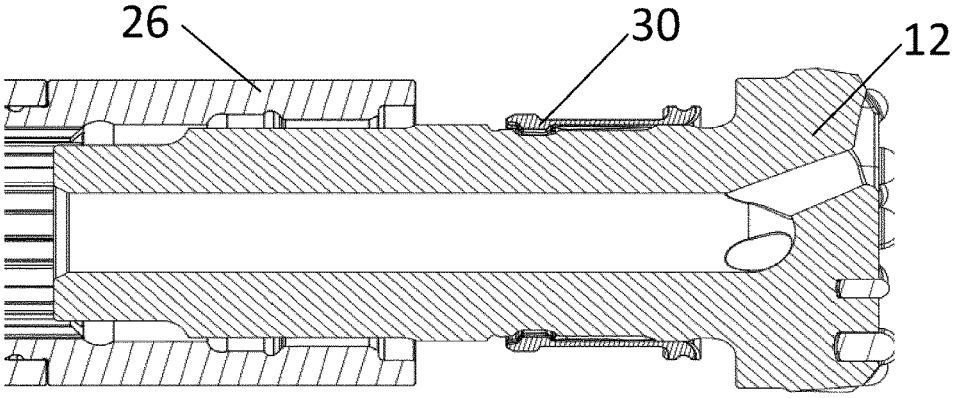
FIGS. 9*a*-9*c* are cross sections of the DTH assembly illustrating how the bit is attached to the rest of the assembly and the DTH assembly in its drilling position.
Figure 9B:
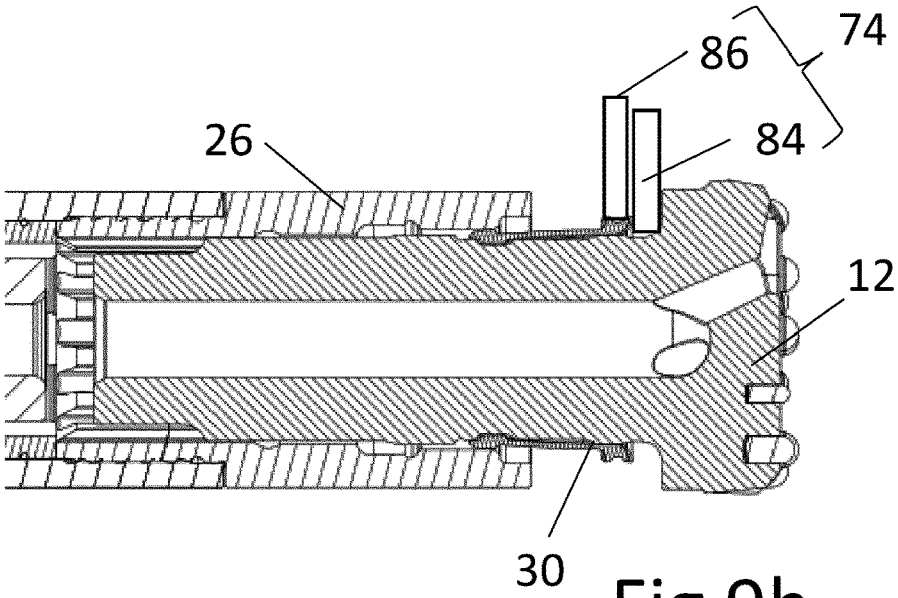
Figure 9C:
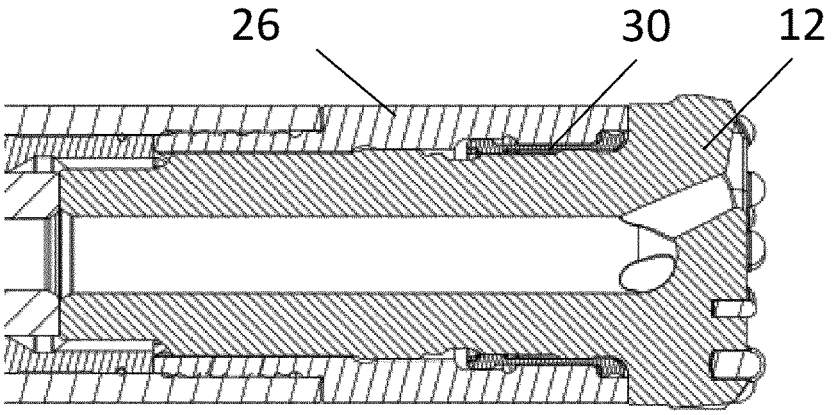

FIGS. 9*a-c* show how the drill bit 12 is mounted into the driver sub 26 so that it is retained therein. FIG. 9*a* shows when the opening groove 66 is positioned on the drill bit 12, first the retaining sleeve 30 is installed around the drill bit 12. Alternatively, if the opening groove 66 is positioned on the driver sub 26, instead the retaining sleeve 30 is installed inside the driver sub 26. A grabbing tool 74 is used to insert the drill bit 12 into the assembly 2. The grabbing tool 74 comprises an extraction plate 86 and a spacer 84. If the groove 66 is positioned on the drill bit 12 the spacer 84 is used to position the retaining sleeve 30 at the appropriate distance from the rearward face of the drill head 16. If groove 66 is positioned on the driver sub 26, the spacer 84 would be used to position the retaining sleeve 30 at the appropriate distance from the forward face of the driver sub 26. The preferred distance between the rearward end of the drill head 12 to the centre point on the radially outer surface 46 of the ring 32 on the retaining sleeve 30 is 5-30 mm i.e. the preferred thickness of the spacer 84 is between 5-30 mm. If the opening groove 66 is positioned on the drill bit 12, then the spacer 84 will position the distance between the retaining sleeve 30 and the drill bit 12 at the appropriate distance such that the radially innermost surface 64 of the retaining ring 30 is positioned above the opening groove 66. If the opening groove 66 is positioned on the driver sub 26, the spacer 84 will position the distance between the retaining sleeve 30 and the driver sub 26 so that the radially outermost surface 60 on the retaining sleeve 30 is positioned below the opening groove 66. Preferably, the grabbing tool 74 will hold the retaining sleeve 30 via the U-shaped groove 48. The drill bit 12 is then rotated relative to the rest of the assembly 2 or the assembly 2 is rotated relative to the drill bit 12 in order to find the correct position where the splines 28 on the drill bit 12 and the splines 88 on the driver sub 26 will engage with each other. If, for example, there are 12 splines on each of the drill bit and the driver sub, this means there would be 12 possible engagement positions. Once the splines 28, 88 are engaged, with the grabbing tool 74 still held in position, the drill bit 12 or the assembly 2 is pressed, for instance using the feed or other existing feature of the drilling machine, or a dedicated apparatus, with a pushing force of for example about 2500 N (~250 kgf). This force means that the body 58 on the retaining sleeve 30 will contract as the drill bit 12 slides further inside the driver sub 26. FIG. 9*b* shows that when the drill bit 12 has been pushed in with the grabbing tool 74, so that the tips 38 of the retaining sleeve 30 are pushed over the stepped region 76 on the driver sub 26, the body 58 will contract and the retaining sleeve 30 can slide inside the driver sub 26 until the tips 38 are pushed past the stepped region 76 and retaining shoulder 82, then the body 58 will revert back to its original, non-contract position. The drill bit 12 is then released from the grabbing tool 74, so that the drill bit 12 is installed inside the hammer assembly 2, and can be moved freely between its drilling position, where the drill bit 12 is fully inside the assembly 2 and the retaining/flushing position, and where the drill bit 12 is fully extended, the inner retaining face 50 is in contact with the first retaining shoulder 68 and the outer retaining face 52 is in contact with the radially inwardly projecting retaining shoulder 82.

FIG. 9*c* also represents the arrangement of the assembly 2 in the drilling position when the drill bit is in contact with the rock. In this position the body 58 could be used for locking, more preferably the tips 38 of the retaining sleeve 30 are locked between the driver sub 26 and the drill bit 12, therefore preventing radial movement of the body 58. Radial movement of the inner retaining shoulder 78 and outer retaining shoulder 80 being limited by drill bit 12 and driver 26 respectively.

Figure 10:
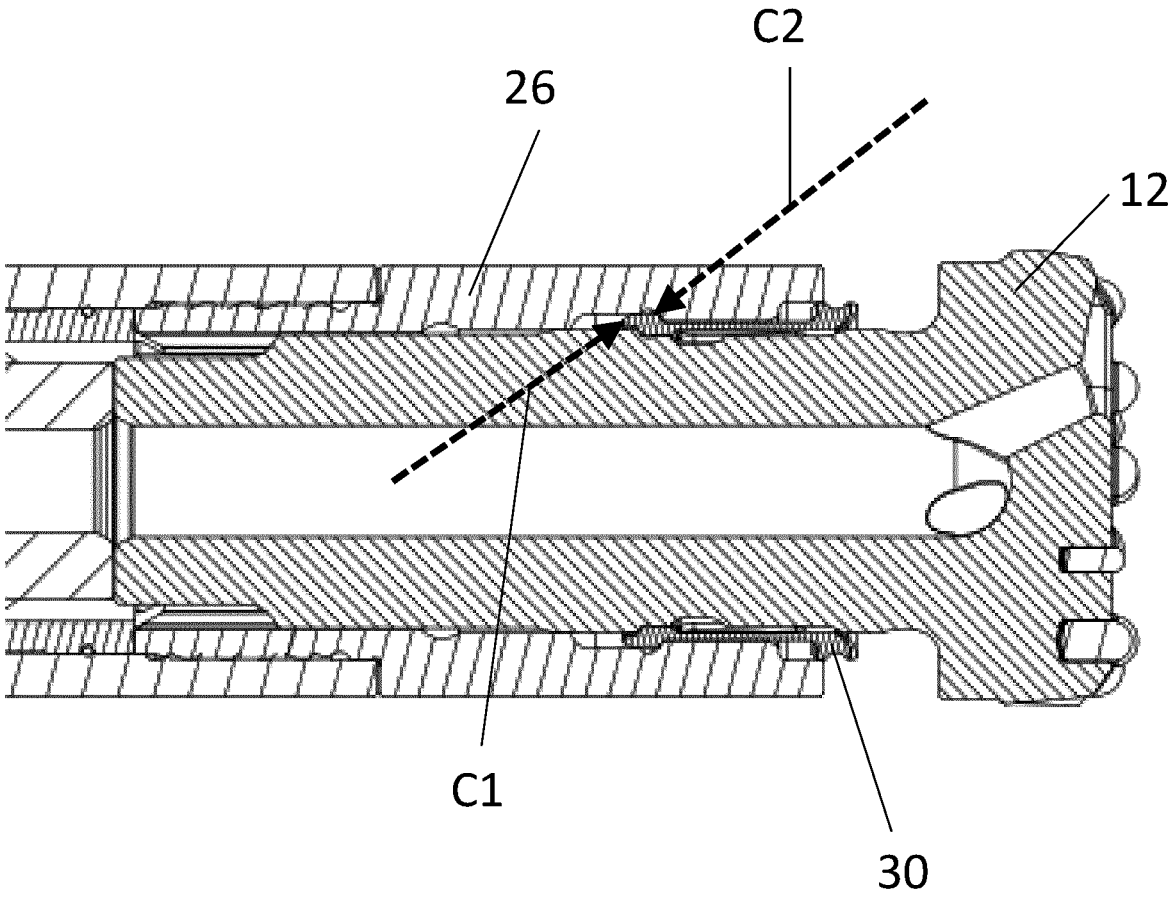
FIG. 10 is a cross section of the DTH assembly in its flushing position.

FIG. 10 shows the assembly 2 in the flushing position. In this case the drill bit 12 is moved axially forward from the driver sub 26, the body 58 on the retaining sleeve 30 is moved over the opening groove 66, which could be positioned on either the drill bit 12 or the driver sub 26, so that the body 58 is locked between the first retaining shoulder 68 on the drill bit 12 and the retaining shoulder 82 on the driver sub 26. Therefore, the body 58 is prevented from bending as it is locked in position. Axial retention is achieved from contact between the inner retaining face 50 on the retaining sleeve 30 and the radially outwardly projecting retaining shoulder 68 that is positioned on the drill bit 12 and from contact between the outer retaining face 52 on the retaining sleeve 30 and radially inwardly projecting retaining shoulder 82 that is positioned on the driver sub 26. Radial movement is limited from contact between the radially outermost surface 60 on the retaining sleeve 30 and the support face 70 on the driver sub 26 and from contact between the radially innermost surface 64 on the retaining sleeve 30 and the support face 92 on the drill bit 12. Therefore, the body 58 is prevented from bending as it is locked in position. When the assembly 2 is in its flushing/retaining position a first contact force, C1, is achieved between the inner retaining face 50 on the retaining sleeve 30 and the first retaining shoulder 68 on the drill bit 12 and a second contact force, C2, is achieved between the outer retaining face 52 on the retaining sleeve 30 and the radially inwardly projecting shoulder 82 that is positioned on the driver sub 26. Preferably, there is a co-linear vector between the first contact force, C1, and second contact forces, C2.

When the drill bit 12 is then moved back to the drilling position via contact between the ring 32 on the retaining sleeve 30 and the rearward surface of the drill head 16, the body 58 on the retaining sleeve 30 is moved over the opening groove 66, either positioned on the drill bit 12 or the driver sub 26, so that bending of the body 58 is prevented.

Figure 11A:
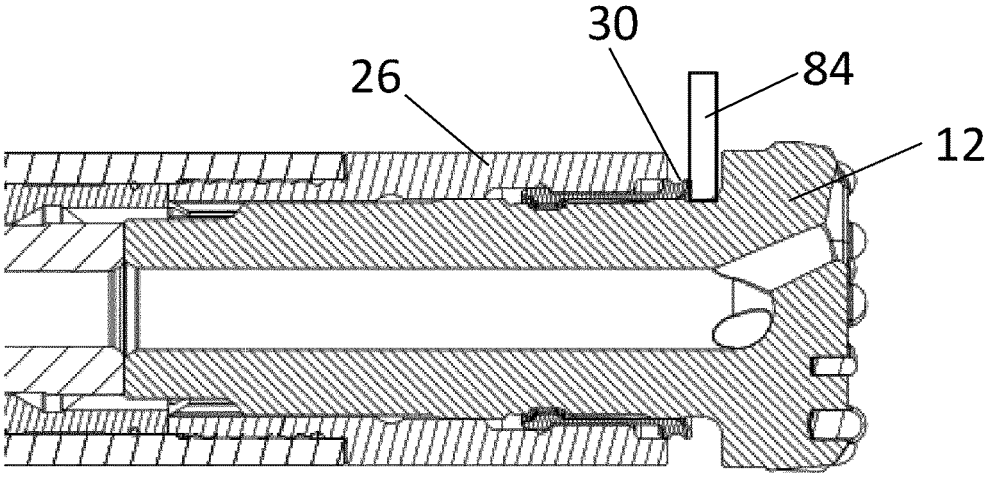
FIGS. 11*a-c* are cross sections of the DTH assembly illustrating how the bit is detached from the rest of the assembly.
Figure 11B:
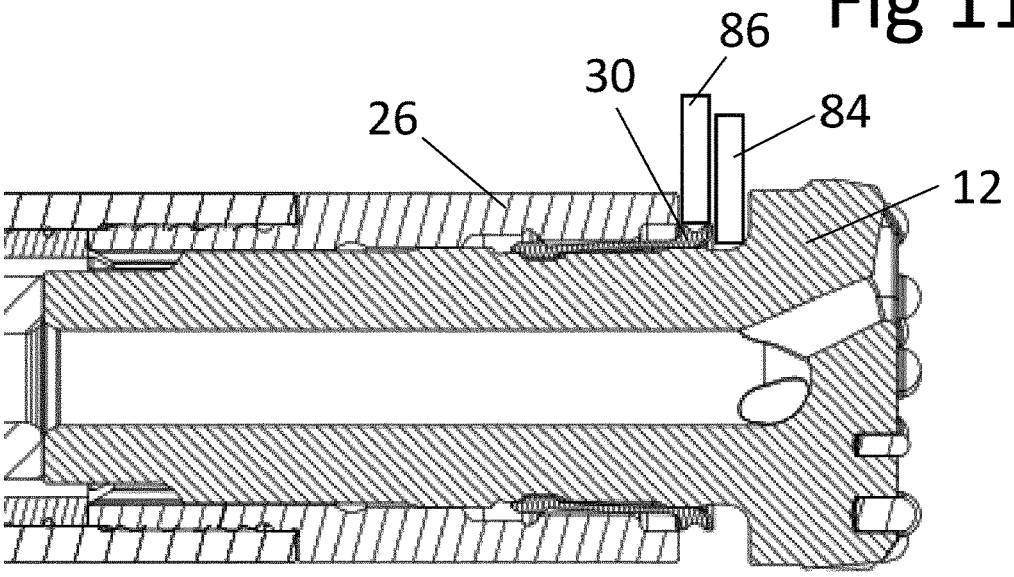
Figure 11C:
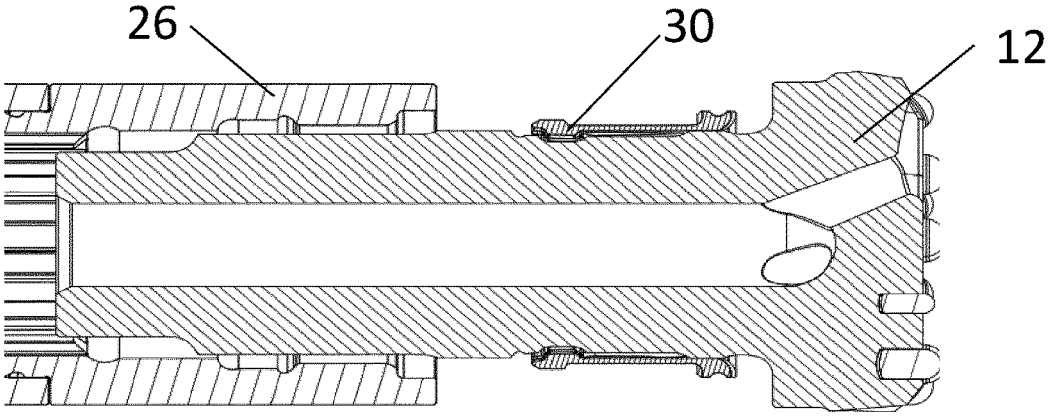

FIGS. 11*a-c* show how the drill bit 12 is removed from the assembly 2. FIG. 11*a* shows that firstly, the drill bit 12 is moved to the flushing position, then the grabbing tool 74 is used to grip onto the retaining sleeve 30, for example via the U-shaped groove 48. With the grabbing tool 74 still in position so the spacer 84 can control the position of the retaining ring 30 relative to the drill bit 12, the drill bit 12 is retracted back into the driver sub 26. If the opening groove 66 is positioned on the drill bit 12, the spacer 84 will position the retaining ring 30 relative to the drill bit 12 so that the radially innermost surface 64 on the retaining ring is positioned above the opening groove 66. If the opening groove 66 is positioned on the driver sub 26, then the spacer 84 will position the retaining sleeve 30 relative to the driver sub 26 so that the radially outermost surface 60 on the retaining sleeve 30 is positioned below the opening groove 66 on the driver sub 26. The retaining sleeve 30 is then pulled out and the tapered outer retaining face 52 on the tips 38 of the retaining sleeve 30 converts part of the axial force to radial force so that the body 58 on the retaining sleeve 30 contracts, with just a slight friction resistance. As the drill bit 12 and the retaining sleeve 30 are pulled axially forward from the driver sub 26 the body 58 on the retaining sleeve 30 reverts back to its original non-contacted position, but the drill bit 12 is still positioned such that the splines 28 on the drill bit 12 and the splines 88 on the driver sub 26 engage with each other. As the drill bit 12 is moved axially further forward the drill bit 12 drops from the splines 28, 88 and the drill bit 12 can be removed from the rest of the assembly 2.

FIGS. 8 to 11 show the option wherein the opening groove 66 is on the drill bit 12, however it should be understood that the alternative option, wherein the opening groove 66 is on the driver sub 26 is also possible. When opening groove 66 is on the driver sub 26, only the bit 12 is pulled out of the assembly, retaining sleeve 30 remains in the driver sub 26.

The invention claimed is:

1. A hammer drill assembly for coupling to a drill string having an axially forward end and an axially rearward end and a longitudinal axis, the assembly comprising:

a drill bit positioned at the forward end having a drill head and a bit shaft; and an annular driver sub provided axially rearward of the drill bit, wherein the bit shaft is accommodated at least partially inside the driver sub, wherein the drill bit is releasably attached to the driver sub via a retaining sleeve, the retaining sleeve being elastically deformable, and wherein the retaining sleeve is radially positioned at least partially between the driver sub and the drill bit, the retaining sleeve comprising:

a plurality of tips positioned inside the driver sub;

a ring positioned axially forward of the tips; and a body that extends between the ring and the plurality of tips at its rearward end, wherein each tip of the plurality of tips has a radially inwardly projecting inner retaining shoulder and a radially outwardly projecting outer retaining shoulder, and wherein there is an inner retaining face on the inner retaining shoulder and an outer retaining face on the outer retaining shoulder.

2. The assembly according to claim 1, wherein the bit shaft includes a radially outwardly projecting retaining shoulder on the radially outer surface of the bit shaft, wherein the driver sub includes a radially inwardly projecting retaining shoulder on its radially inner surface, and wherein either the bit shaft of the drill bit or the driver sub includes an opening groove.

3. The assembly according to claim 1, wherein the retaining sleeve is made from an elastically deformable material.

4. The assembly according to claim 1, wherein the retaining sleeve is made from heat-treated steel.

5. The assembly according to claim 1, wherein the body of the ring includes a plurality of fingers, wherein there is a gap between neighbouring fingers, and at least one tip is positioned at the end of each finger.

6. The assembly according to claim 5, wherein the retaining sleeve includes between 3-30 fingers.

7. The assembly according to claim 5, wherein a width of the gaps between each neighbouring fingers on the ring increases along an axial length of the fingers from the ring towards the tip and then decreases in width between each neighbouring tips.

8. The assembly according to claim 1, wherein a radially outer surface on the ring of the retaining sleeve has a U-shaped groove.

9. The assembly according to claim 1, wherein an axially forward surface and/or an axially rearward surface of the ring on the retaining sleeve includes a damping element.

10. The assembly according to claim 1, wherein a rearward axial endmost surface on each of the tips on the retaining sleeve is chamfered.

11. The assembly according to claim 2, wherein when the assembly is in a flushing position, between the inner retaining face on the retaining sleeve and the radially outwardly projecting retaining shoulder on the drill bit, a first contact force is achieved and between the outer retaining face on the retaining sleeve and the radially inwardly projecting retaining shoulder on the driver sub a second contact force is achieved.

12. The assembly according to claim 11, wherein there is a co-linear vector between the first and second contact forces.

13. The assembly according to claim 2, wherein the drill bit or the driver sub further includes a tapered support face extending between the retaining shoulder and the opening groove.

14. The assembly according to claim 1, wherein the driver sub includes a chamfer on its axial forward end for entry of the retaining sleeve.

15. The assembly according to claim 1, wherein the bit shaft and the driver sub have a plurality of interlocking splines.

16. A drill bit for an assembly according to claim 1 having a forward end; a rearward end and a longitudinal axis, the drill bit comprising:

a drill head at its forward end;

a bit shaft; and a plurality of splines on the outer surface of the bit shaft at the rearward end, wherein there is a radially inwardly projecting opening groove on the bit shaft positioned axially between the splines and the drill head and a radially outwardly projecting retaining shoulder that projects radially outwards compared to the opening groove positioned on the rearward side of the opening groove.

17. A driver sub for an assembly according to claim 1 having a forward end; a rearward end and a longitudinal axis, wherein there is a radially outwardly projecting opening groove on its inner surface and a radially inwardly projecting retaining shoulder positioned on the forward side of the opening groove.

18. A method of attaching a drill bit to the assembly according to claim 15 when an opening groove is positioned on the drill bit, the method comprising the steps of:

a. installing the retaining sleeve around the drill bit;

b. positioning a spacer between the retaining sleeve and the drill bit so that an innermost surface of the tips on the retaining sleeve is positioned above the opening groove;

c. gripping the retaining sleeve with a grabbing tool;

d. rotating the drill bit or assembly until engagement between the splines on the drill bit and the splines on the driver sub is achieved;

e. applying axial force to the drill bit or assembly so that the body on the retaining sleeve contracts as the drill bit slides inside the driver sub;

f. pushing the drill bit so that the tips of the retaining sleeve are pushed past a stepped region on the driver sub and the body of the retaining ring reverts back to its original, non-contracted, position; and g. releasing the drill bit from the grabbing tool.

19. A method of attaching a drill bit to the assembly according to claim 15 when an opening groove is positioned on the driver sub, the method comprising the steps of:

a. installing the retaining sleeve inside the driver sub;

b. positioning a spacer between the retaining sleeve and the driver sub so that a radially outermost surfaces of the tips on the retaining sleeve are positioned above the opening groove on the driver sub;

c. gripping the retaining sleeve using a grabbing tool;

d. rotating the drill bit or assembly until engagement between the splines on the drill bit and the splines on the driver sub is achieved;

e. applying axial force to the drill bit or assembly so that the body of the retaining sleeve expands as the drill bit slides inside the driver sub;

f. pushing the drill bit so that the tips on the retaining sleeve are pushed past a retaining shoulder of the drill bit and the body reverts back to its original, non-expanded, position; and g. releasing the drill bit from the grabbing tool.

20. A method of detaching the drill bit from the assembly according to claim 15 when an opening groove is positioned on the drill bit, the method comprising the steps of:

a. extending the drill bit to its flushing position;

b. gripping the retaining sleeve with a grabbing tool;

c. positioning a spacer between the retaining sleeve and the drill bit;

d. pushing the drill bit partially back inside the assembly so that an innermost surface of the tips on the retaining sleeve are positioned above the opening groove on the drill bit;

e. axially pulling the retaining sleeve or the assembly from the assembly so that the body of the retaining sleeve contracts;

f. continuing pulling the retaining sleeve until the body of the retaining ring reverts back to its original position; and g. pulling the drill bit axially further forward so that the splines on the drill bit and the driver sub disengage and the drill bit and retaining sleeve can be removed from the rest of the assembly.

21. A method of detaching the drill bit from the assembly according to claim 15 when an opening groove is positioned on the driver sub, the method comprising the steps of:

a. extending the drill bit to its flushing position;

b. gripping the retaining sleeve with a grabbing tool;

c. positioning a spacer between the retaining sleeve and the driver sub;

d. pushing the retaining sleeve at least partially back inside the assembly so that a radially outermost surfaces of the tips on the retaining sleeve are positioned above the opening groove on the driver sub;

e. axially pulling the drill bit from the assembly so that the body of the retaining sleeve expands;

f. continuing pulling the drill bit until the body of the retaining ring reverts at partially back to towards its original position; and g. pulling the drill bit axially further forward so that the splines on the drill bit and the driver sub disengage and the drill bit can be removed from the rest of the assembly.

* * * * *